US010029471B2

(12) United States Patent
Okubo

(10) Patent No.: US 10,029,471 B2
(45) Date of Patent: Jul. 24, 2018

(54) LIQUID EJECTING APPARATUS AND METHOD FOR CONTROLLING LIQUID EJECTING APPARATUS

(71) Applicant: SEIKO EPSON CORPORATION, Tokyo (JP)

(72) Inventor: Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/412,927

(22) Filed: Jan. 23, 2017

(65) Prior Publication Data

US 2017/0210139 A1 Jul. 27, 2017

(30) Foreign Application Priority Data

Jan. 27, 2016 (JP) ..... 2016-012919

(51) Int. Cl.
*B41J 2/175* (2006.01)
*B41J 2/19* (2006.01)

(52) U.S. Cl.
CPC ..... *B41J 2/17563* (2013.01); *B41J 2/17596* (2013.01)

(58) Field of Classification Search
CPC ..... B41J 2/19; B41J 2/17563; B41J 2/17596; B41J 2002/14403
See application file for complete search history.

(56) References Cited

U.S. PATENT DOCUMENTS 8,360,567 B2 * 1/2013 Ito ..... B41J 2/19 347/84
8,403,471 B2 * 3/2013 Ito ..... B41J 2/17509 347/85
8,459,786 B2 * 6/2013 Ito ..... B41J 2/17509 347/85
2002/0047882 A1 * 4/2002 Karlinski ..... B41J 2/175 347/85
2003/0202057 A1 * 10/2003 Childs ..... B41J 2/175 347/85
2006/0090645 A1 * 5/2006 Kent ..... A61M 1/1658 95/46
2008/0170098 A1 * 7/2008 Kojima ..... B41J 2/17509 347/21
2008/0231650 A1 * 9/2008 Kojima ..... B41J 2/055 347/17

(Continued)

FOREIGN PATENT DOCUMENTS

JP 2000-296622 A 10/2000
JP 2010-201829 A 9/2010

*Primary Examiner* — Patrick King
(74) *Attorney, Agent, or Firm* — Workman Nydegger

(57) ABSTRACT

A liquid ejecting apparatus includes a flow channel through which liquid is supplied to a liquid ejecting head, a gas permeable film that constitutes a wall surface of the flow channel, an air chamber that is separated from the flow channel through intermediation of the gas permeable film, and a pressure regulating section for changing an air pressure inside the air chamber with respect to a reference pressure. The gas permeable film is configured to change a volume of the flow channel through a change in the air pressure inside the air chamber with the pressure regulating section, and allow permeation of an air bubble when the pressure regulating section decreases the air pressure inside the air chamber.

12 Claims, 13 Drawing Sheets

(56) References Cited

U.S. PATENT DOCUMENTS

| | | | | |
|---|---|---|---|---|
| 2008/0246823 | A1* | 10/2008 | Comas | B41J 2/16526 347/85 |
| 2008/0297579 | A1* | 12/2008 | Umeda | B41J 2/175 347/92 |
| 2009/0058907 | A1* | 3/2009 | Umeda | B41J 2/175 347/14 |
| 2009/0058970 | A1* | 3/2009 | Umeda | B41J 2/175 347/93 |
| 2009/0179974 | A1* | 7/2009 | Kimura | B41J 2/17509 347/85 |
| 2009/0315959 | A1* | 12/2009 | Fukazawa | B41J 2/175 347/85 |
| 2010/0225718 | A1* | 9/2010 | Uezawa | B41J 2/17509 347/93 |
| 2011/0211029 | A1* | 9/2011 | Enomoto | B41J 2/175 347/93 |
| 2012/0038721 | A1* | 2/2012 | Yokouchi | B41J 2/17509 347/93 |
| 2016/0144628 | A1* | 5/2016 | Sato | B41J 2/17596 347/85 |

* cited by examiner

LIQUID EJECTING APPARATUS AND METHOD FOR CONTROLLING LIQUID EJECTING APPARATUS

The present application claims priority to Japanese Patent Application No. 2016-012919 filed on Jan. 27, 2016, which is hereby incorporated by reference in its entirety.

BACKGROUND

1. Technical Field

The present invention relates to a technique for ejecting liquid such as ink onto a medium.

2. Related Art

In a liquid ejecting apparatus that ejects liquid such as ink from nozzles of a liquid ejecting head, there is an issue of removing air bubbles contained in the liquid inside a flow channel extending from a liquid container (cartridge) to each nozzle of the liquid ejecting head. For example, JP-A-2010-201829 describes such a technique that a part of the wall of a filter chamber provided midway along the flow channel is formed of a flexible thin film. In the structure of JP-A-2010-201829, the flexible thin film is deflected from an upstream side of the flow channel to force out air bubbles on an upstream side of a filter toward a downstream side of the filter, thereby discharging the air bubbles.

In the structure of JP-A-2010-201829, however, air bubbles are not discharged sufficiently since the flexible thin film is merely deflected from the upstream side of the flow channel to force out the air bubbles on the upstream side of the filter toward the downstream side of the filter.

SUMMARY

An advantage of some aspects of the invention is that the dischargeability of air bubbles inside a flow channel is enhanced.

First Aspect

A liquid ejecting apparatus according to a preferred aspect (first aspect) of the invention includes a flow channel through which liquid is supplied to a liquid ejecting head, a gas permeable film that constitutes a wall surface of the flow channel, an air chamber that is separated from the flow channel through intermediation of the gas permeable film, and a pressure regulating section that increases/decreases an air pressure inside the air chamber with respect to a reference pressure. The gas permeable film increases/decreases a volume of the flow channel through a change in the air pressure inside the air chamber with the pressure regulating section, and allows permeation of an air bubble when the pressure regulating section decreases the air pressure inside the air chamber. In the first aspect, the gas permeable film increases/decreases the volume of the flow channel through the change in the air pressure inside the air chamber with the pressure regulating section, and the air bubble permeates the gas permeable film when the pressure regulating section decreases the air pressure inside the air chamber. Therefore, the discharge of the air bubble inside the flow channel toward the downstream side can be promoted, and further, the air bubble inside the flow channel can be discharged by permeating the gas permeable film. Thus, the dischargeability of air bubbles inside the flow channel can be enhanced.

Second Aspect

In a preferred example (second aspect) of the first aspect, the liquid ejecting apparatus further includes a filter that is provided midway along the flow channel so as to face the gas permeable film, and partitions the flow channel into an upstream side and a downstream side, and the gas permeable film is arranged on the upstream side of the filter in the flow channel. According to the second aspect, the air bubble removed by the filter can be discharged from the gas permeable film.

Third Aspect

In a preferred example (third aspect) of the second aspect, when the gas permeable film decreases the volume of the flow channel on the upstream side, the air bubble inside the flow channel on the upstream side is discharged by being forced out toward the downstream side of the filter, and when the gas permeable film increases the volume of the flow channel on the upstream side, the air bubble inside the flow channel on the upstream side is discharged by permeating the gas permeable film. According to the third aspect, when the gas permeable film decreases the volume of the flow channel on the upstream side, the air bubble inside the flow channel on the upstream side is discharged by being forced out toward the downstream side of the filter, and when the gas permeable film increases the volume of the flow channel on the upstream side, the air bubble inside the flow channel on the upstream side is discharged by permeating the gas permeable film. Thus, the dischargeability of air bubbles inside the flow channel can be enhanced.

Fourth Aspect

In a preferred example (fourth aspect) of the first aspect, the liquid ejecting apparatus further includes a valve body that is provided midway along the flow channel so as to face the gas permeable film, and opens/closes the flow channel, an urging member that urges the valve body in a closing direction, and a switching member that switches opening/closing of the valve body along with displacement of the gas permeable film. According to the fourth aspect, the opening/closing of the valve body can be switched through the displacement of the gas permeable film.

Fifth Aspect

In a preferred example (fifth aspect) of the fourth aspect, when the gas permeable film is displaced so as to decrease the volume of the flow channel, the switching member opens the valve body to discharge the air bubble inside the flow channel by causing the air bubble to flow toward the downstream side, and when the gas permeable film is displaced so as to increase the volume of the flow channel, the switching member closes the valve body to discharge the air bubble inside the flow channel by causing the air bubble to permeate the gas permeable film. According to the fifth aspect, when the gas permeable film is displaced so as to decrease the volume of the flow channel, the switching member opens the valve body to discharge the air bubble inside the flow channel by causing the air bubble to flow toward the downstream side, and when the gas permeable film is displaced so as to increase the volume of the flow channel, the switching member closes the valve body to discharge the air bubble inside the flow channel by causing the air bubble to permeate the gas permeable film. Thus, the dischargeability of air bubbles inside the flow channel can be enhanced.

Sixth Aspect

In a preferred example (sixth aspect) of one of the first to fifth aspect, the liquid ejecting apparatus further includes a check valve that communicates with the air chamber, and the check valve is a valve that prevents entry of air into the air chamber. According to the sixth aspect, the check valve prevents the entry of air into the air chamber, and hence the discharge of air bubbles via the air chamber by permeation of the air bubbles through the gas permeable film can be performed for a long period of time.

Seventh Aspect

In a preferred example (seventh aspect) of the sixth aspect, a period of time for decreasing the air pressure inside the air chamber with respect to the reference pressure is longer than a period of time for increasing the air pressure inside the air chamber with respect to the reference pressure. According to the seventh aspect, the discharge of air bubbles via the air chamber by permeation of the air bubbles through the gas permeable film can be performed for a long period of time.

Eighth Aspect

In a preferred example (eighth aspect) of one of the first to seventh aspect, the gas permeable film has a bag shape, and is arranged inside the flow channel with an internal space of the gas permeable film set as the air chamber, and the air chamber is provided with a frame that prevents an air inlet/outlet port from being closed by the gas permeable film. According to the eighth aspect, the internal space of the gas permeable film having a bag shape is set as the air chamber. Therefore, when the air pressure inside the air chamber is increased, the gas permeable film is inflated to decrease the volume of the flow channel, and when the air pressure inside the air chamber is decreased, the gas permeable film is deflated to increase the volume of the flow channel. Thus, the discharge of the air bubble inside the flow channel is promoted by increasing the air pressure inside the air chamber to inflate the gas permeable film, and the air bubble inside the flow channel is discharged through the gas permeable film by decreasing the air pressure inside the air chamber. Accordingly, the dischargeability of air bubbles inside the flow channel can be enhanced. Moreover, in the eighth aspect, the air chamber is provided with the frame that prevents the air inlet/outlet port from being closed by the gas permeable film. Thus, even when the gas permeable film is deflated by decreasing the air pressure inside the air chamber, owing to the interference of the frame, the inlet/outlet port of the air chamber can be prevented from being closed by the gas permeable film.

Ninth Aspect

In a preferred example (ninth aspect) of one of the first to eighth aspect, the gas permeable film has a bag shape with inner surfaces facing each other, and is arranged inside the flow channel with an internal space of the gas permeable film set as the air chamber, and the gas permeable film is provided with a protrusion that protrudes from one of the inner surfaces facing each other toward another one of the inner surfaces facing each other. In the ninth aspect, the gas permeable film is arranged inside the flow channel with the internal space of the gas permeable film set as the air chamber, and the gas permeable film is provided with the protrusion that protrudes from one of the inner surfaces facing each other toward another one of the inner surfaces facing each other. Thus, even when the gas permeable film is deflated by decreasing the air pressure inside the air chamber, owing to the interference of the protrusion, the inlet/outlet port of the air chamber can be prevented from being closed by the gas permeable film.

Tenth Aspect

In a preferred example (tenth aspect) of the second or third aspect, the gas permeable film forms, inside the flow channel, a wall surface that covers the flow channel, and when the gas permeable film decreases the volume of the flow channel, a closing portion that closes the flow channel by being deflected toward an inner side of the flow channel on the upstream side of the filter is formed on the gas permeable film. According to the tenth aspect, the flow channel can be closed by the closing portion of the gas permeable film.

Eleventh Aspect

In a preferred example (eleventh aspect) of the tenth aspect, when the gas permeable film decreases the volume of the flow channel, the air bubble inside the flow channel is discharged by being forced out toward the downstream side of the filter after the closing portion closes the flow channel. According to the eleventh aspect, the air bubble can be made less liable to flow back toward the inlet side than in a case where the flow channel on the inlet side of the gas permeable film is not closed.

Twelfth Aspect

In a preferred example (twelfth aspect) of one of the second to fourth aspect, the gas permeable film forms, inside the flow channel, a wall surface that covers the flow channel, and when the gas permeable film decreases the volume of the flow channel, the liquid is pumped from the upstream side of the flow channel. According to the twelfth aspect, when the gas permeable film decreases the volume of the flow channel, the liquid is pumped from the upstream side of the flow channel, and hence the air bubble can be prevented from flowing back toward the upstream side of the flow channel.

Thirteenth Aspect

A method for controlling a liquid ejecting apparatus according to a preferred aspect (thirteenth aspect) of the invention is a method for controlling a liquid ejecting apparatus including a liquid ejecting head, a flow channel through which liquid is supplied to the liquid ejecting head, a gas permeable film that constitutes a wall surface of the flow channel, an air chamber that is separated from the flow channel through intermediation of the gas permeable film, and a pressure regulating section that increases/decreases an air pressure inside the air chamber with respect to a reference pressure. The method includes changing the air pressure inside the air chamber with the pressure regulating section, decreasing a volume of the flow channel through the changing of the air pressure inside the air chamber, and increasing the volume of the flow channel through the changing of the air pressure inside the air chamber. According to the thirteenth aspect, the volume of the flow channel can be increased/decreased by changing the air pressure inside the air chamber with the pressure regulating section.

Fourteenth Aspect

In a preferred example (fourteenth aspect) of the thirteenth aspect, the liquid ejecting apparatus further includes a filter that is provided midway along the flow channel so as to face the gas permeable film, and partitions the flow channel into an upstream side and a downstream side. The gas permeable film is arranged on the upstream side of the filter in the flow channel. The method includes discharging an air bubble inside the flow channel on the upstream side by forcing out the air bubble toward the downstream side of the filter through the decreasing of the volume of the flow channel. According to the fourteenth aspect, the air bubble inside the flow channel on the upstream side is discharged by being forced out toward the downstream side of the filter through the decreasing of the volume of the flow channel, which is caused by changing the air pressure inside the air chamber with the pressure regulating section. Thus, the dischargeability of air bubbles inside the flow channel can be enhanced.

Fifteenth Aspect

In a preferred example (fifteenth aspect) of the thirteenth aspect, the liquid ejecting apparatus further includes a valve body that is provided midway along the flow channel so as to face the gas permeable film, and opens/closes the flow channel, an urging member that urges the valve body in a closing direction, and a switching member that switches opening/closing of the valve body along with displacement of the gas permeable film. The method includes discharging an air bubble inside the flow channel by causing the air bubble to flow toward the downstream side through opening of the valve body with the switching member, which is caused by displacing the gas permeable film so as to decrease the volume of the flow channel. According to the fifteenth aspect, the air bubble inside the flow channel is discharged by flowing toward the downstream side through the opening of the valve body with the switching member, which is caused by displacing the gas permeable film so as to decrease the volume of the flow channel. Thus, the dischargeability of air bubbles inside the flow channel can be enhanced.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
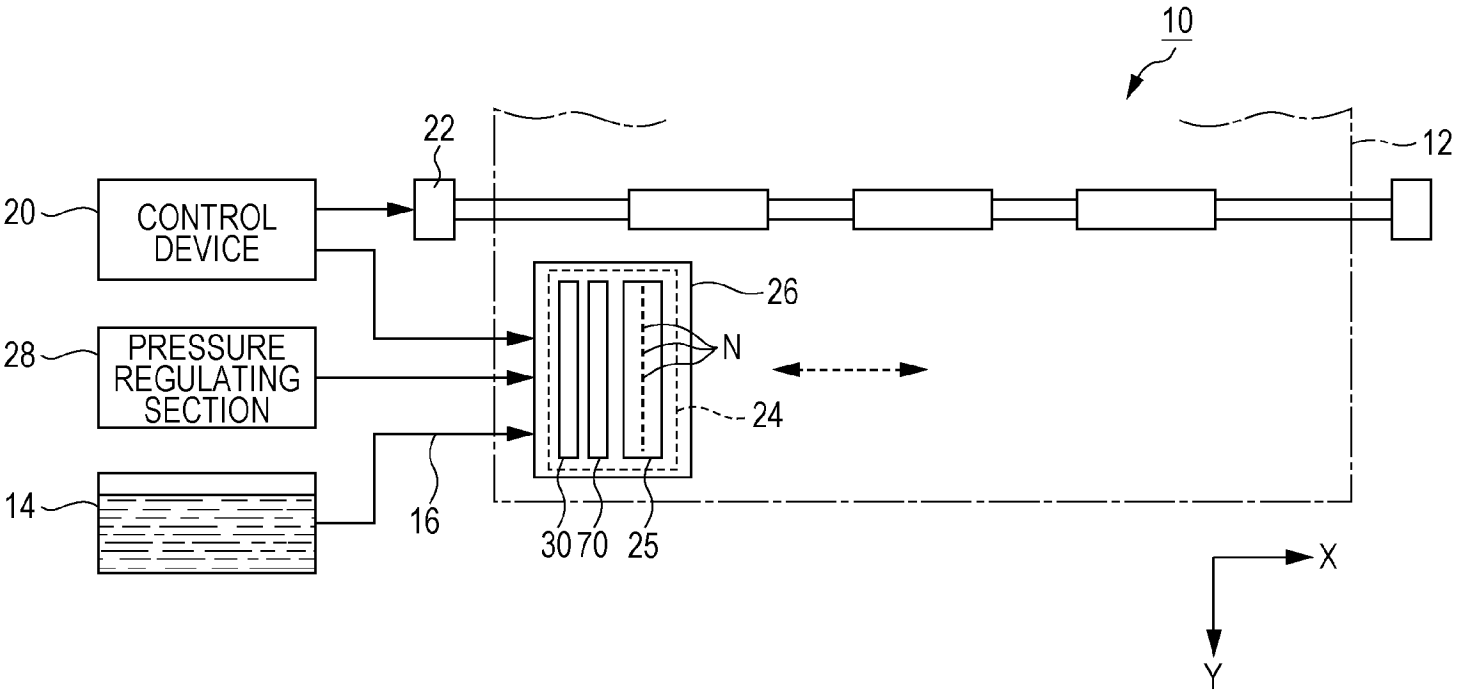
FIG. 1 is a structural diagram of a liquid ejecting apparatus according to a first embodiment.

FIG. 1 is a partial structural diagram of a liquid ejecting apparatus 10 according to a first embodiment of the invention. The liquid ejecting apparatus 10 of the first embodiment is an ink jet printer that ejects ink as an example of liquid onto a medium 12 such as print paper. The liquid ejecting apparatus 10 illustrated in FIG. 1 includes a control device 20, a transport mechanism 22, a liquid ejecting unit 24, a carriage 26, and a pressure regulating section 28. A liquid container (cartridge) 14 that stores the ink is mounted on the liquid ejecting apparatus 10. The ink is supplied from the liquid container 14 to the liquid ejecting unit 24 via a liquid supplying tube 16.

The control device 20 comprehensively controls the respective elements of the liquid ejecting apparatus 10. The transport mechanism 22 transports the medium 12 in a Y direction under the control of the control device 20. The liquid ejecting unit 24 includes a filter unit 30, a valve unit 70, and a liquid ejecting head 25. The liquid ejecting head 25 ejects the ink onto the medium 12 from each of a plurality of nozzles N under the control of the control device 20. The liquid ejecting head 25 incorporates a plurality of sets of pressure chambers and piezoelectric elements (not shown) corresponding to the nozzles N that are different from each other. The pressure inside the pressure chamber is varied by vibrating the piezoelectric element through supply of a drive signal, so that the ink stored in the pressure chamber is ejected from each nozzle N.

The liquid ejecting unit 24 is mounted on the carriage 26. The control device 20 causes the carriage 26 to move reciprocally in an X direction intersecting with the Y direction. The liquid ejecting head 25 ejects the ink onto the medium 12 along with the transport of the medium 12 by the transport mechanism 22 and the repetitive reciprocal movement of the carriage 26, thereby forming a desired image on the surface of the medium 12. For example, a plurality of liquid ejecting units 24 that eject different kinds of ink may be mounted on the carriage 26. Each of the filter unit 30 and the valve unit 70 is such a structure that a flow channel P through which the ink supplied from the liquid container 14 via the liquid supplying tube 16 is supplied to the liquid ejecting head 25 is formed inside. The valve unit 70 functions as a valve device that regulates the pressure of the ink by controlling opening/closing inside the flow channel P with a valve body (switching member). The filter unit 30 functions as a filter device that collects, with a filter, air bubbles or foreign substances contained in the ink inside the flow channel P.

Filter Unit

Figure 2:
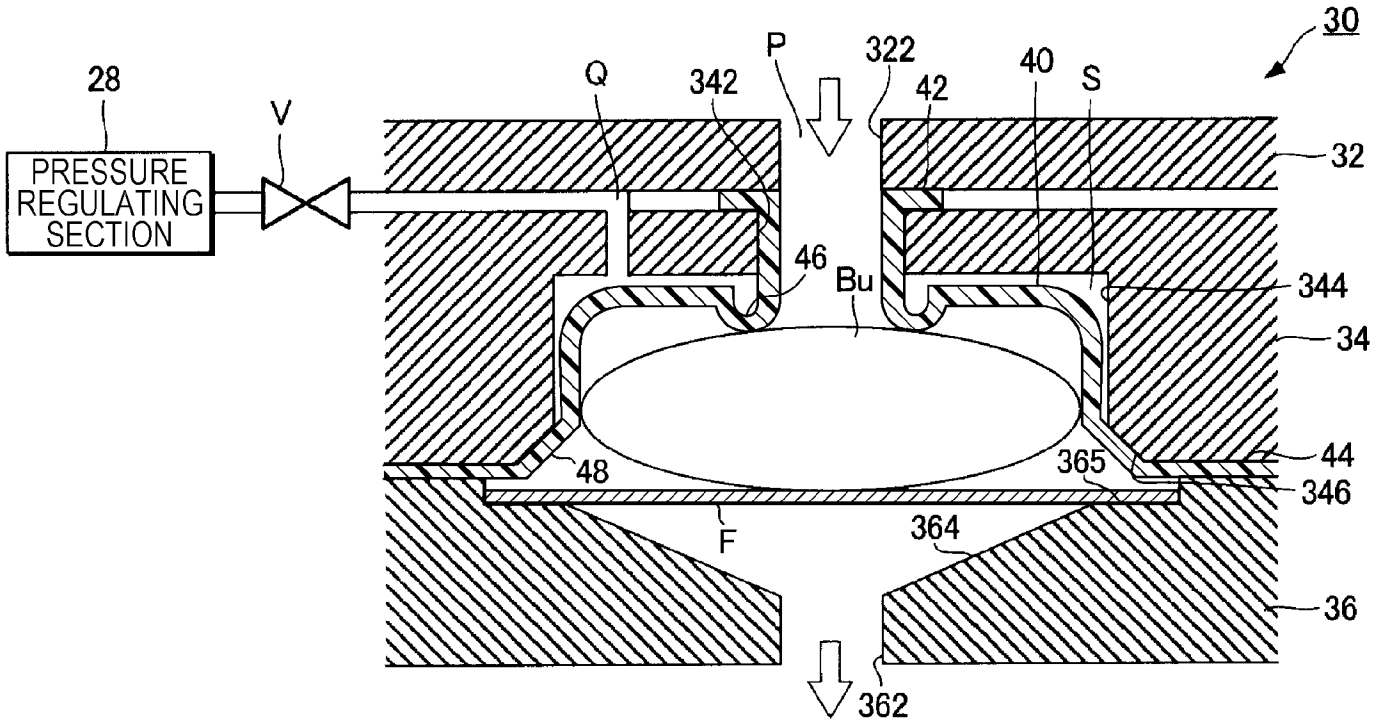
FIG. 2 is a sectional view illustrating the structure of a filter unit.

The first embodiment is described by exemplifying the filter unit 30 capable of enhancing the dischargeability of air bubbles inside the flow channel P by using a gas permeable film that allows permeation of gas while preventing permeation of liquid. FIG. 2 illustrates an example of the structure of the filter unit 30 of the first embodiment. As illustrated in FIG. 2, the filter unit 30 of the first embodiment includes a support 32, an air chamber forming member 34, and a support 36. The air chamber forming member 34 is fixed between the support 32 and the support 36.

A flow channel 322 is formed in the support 32, and a flow channel 362 is formed in the support 36. The flow channel 322 is a through hole that passes through the support 32 from one surface to the other surface thereof. A recess 344 having a substantially circular shape in plan view is formed on the surface of the air chamber forming member 34 which is located on the support 36 side. A flow channel 342 that communicates with the recess 344 is formed on the surface of the air chamber forming member 34 which is located on the support 32 side. The flow channel 342 communicates with the flow channel 322 on the support 32 side. The diameter of the recess 344 is larger than the diameter of the flow channel 342. A tapered liquid flow port 346 that is increased in diameter toward the support 36 is formed at the open end of the recess 344.

A tapered liquid flow port 364 that communicates with the flow channel 362 and is increased in diameter toward the air chamber forming member 34 is formed in the support 36. A stepped portion 365 to which the peripheral edge of a filter (filter element) F is attached is formed at the open end of the liquid flow port 364 of the support 36. The filter F is fixed to the stepped portion 365 by means of, for example, heat welding. With this structure, the filter F is arranged between the tapered liquid flow port 346 and the tapered liquid flow port 364, and hence the performance of removing air bubbles or foreign substances can be enhanced while reducing the resistance in the flow channel.

A gas permeable film 40 is provided inside the recess 344. The gas permeable film 40 is a flexible member that allows permeation of gas while preventing permeation of liquid, and is formed of a resin material such as polypropylene (PP). The gas permeable film 40 has a substantially tubular shape, and is attached inside the recess 344 in a deformable manner. Specifically, a flange 42 is formed at one end of the gas permeable film 40. The flange 42 is attached to the open end of the flow channel 342 of the air chamber forming member 34, and is held by the support 32. The flange 42 is fixed by being interposed between the air chamber forming member 34 and the support 32. The flange 42 may be bonded with an adhesive. A flange 44 is also formed at the other end of the gas permeable film 40. The flange 44 is attached to the open end of the liquid flow port 346 of the air chamber forming member 34, and is held by the support 36. The flange 44 is fixed by being interposed between the air chamber forming member 34 and the support 36. The flange 44 may be bonded with an adhesive.

In the structure of the filter unit 30 described above, the flow channel 322, an internal space of the gas permeable film 40, the liquid flow port 364, and the flow channel 362 constitute the flow channel P through which the ink supplied from the liquid container 14 via the liquid supplying tube 16 is supplied to the liquid ejecting head 25. In this manner, the gas permeable film 40 constitutes a wall surface of the ink flow channel P. The filter F is arranged midway along the flow channel P so as to face the gas permeable film 40. The flow channel P is partitioned by the filter F into a space on an upstream side of the filter F and a space on a downstream side of the filter F.

The inside of the recess 344 of the air chamber forming member 34 is separated into the internal space of the gas permeable film 40 and an external space of the gas permeable film 40 through intermediation of the gas permeable film 40. An air chamber S of the first embodiment is formed by the space on the outer side of the gas permeable film 40 inside the recess 344, that is, the space surrounded by an inner wall of the recess 344 and an outer wall of the gas permeable film 40.

A gas flow channel Q that communicates with the air chamber S is formed in the air chamber forming member 34. A check valve V is provided in the gas flow channel Q, and communicates with the pressure regulating section 28. The pressure regulating section 28 of the first embodiment has a function of increasing/decreasing an air pressure inside the air chamber S with respect to a reference pressure, and is typically formed of a pneumatic pump. With the pressure regulating section 28, the air pressure inside the air chamber S can be changed. Through such a change in the air pressure inside the air chamber S with respect to the reference pressure, the gas permeable film 40 is deflected to increase/decrease the volume of the ink flow channel P inside the recess 344. In this case, the reference pressure inside the air chamber S typically refers to an air pressure inside the air chamber S at the time of normal printing, and is, for example, −1 kPa.

Thus, the pressure regulating section 28 increases the pressure inside the air chamber S with respect to the reference pressure to decrease the volume of the ink flow channel P. In this manner, air bubbles in the internal space of the gas permeable film 40 can be discharged by being forced out toward the downstream side of the filter F. Further, the pressure regulating section 28 decreases the pressure inside the air chamber S with respect to the reference pressure. In this manner, air bubbles remaining in the flow channel P on the inner side of the gas permeable film 40 can also be discharged by permeating the gas permeable film 40. The decreased pressure ranges, for example, from a pressure lower than the reference pressure up to about −60 kPa, and is typically −30 kPa.

The check valve V is a valve that prevents entry of air into the air chamber S from the pressure regulating section 28 side. Since the check valve V prevents the entry of air into the air chamber S, the discharge of air bubbles via the air chamber by permeation of the air bubbles through the gas permeable film can be performed for a long period of time. Note that the check valve V functions when the pressure inside the air chamber S is decreased with respect to the reference pressure, and is configured to be forcibly openable when the pressure inside the air chamber S is increased with respect to the reference pressure. By forcibly opening the check valve V when the pressure inside the air chamber S is increased, air can easily be sent into the air chamber S.

Method for Controlling Filter Unit and Operation Thereof

Figure 3:
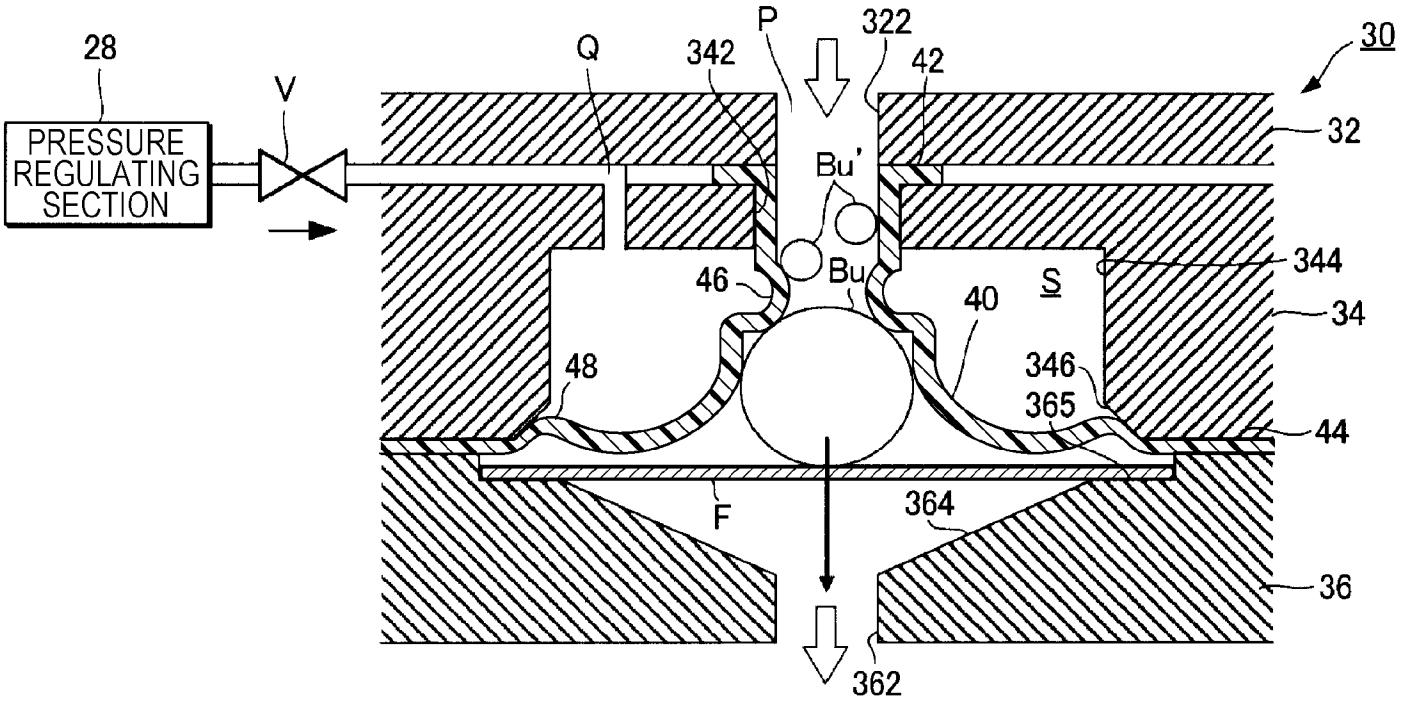
FIG. 3 is an explanatory view of an operation of the filter unit.
Figure 4:
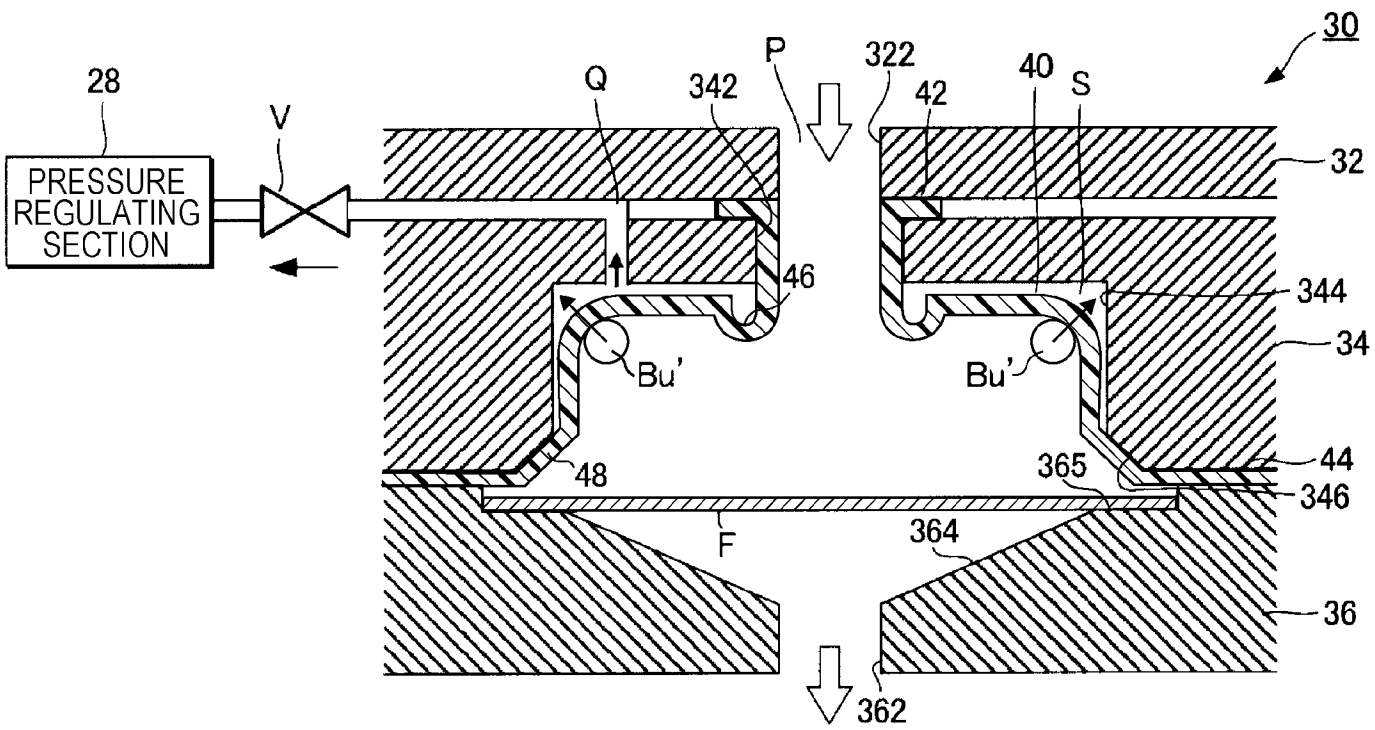
FIG. 4 is an explanatory view of the operation of the filter unit.

Next, a method for controlling the filter unit 30 and an operation thereof are described in detail. FIG. 3 and FIG. 4 are explanatory views of the operation of the filter unit 30 of FIG. 2. FIG. 3 illustrates a state in which air bubbles are discharged by being forced out with the gas permeable film 40 through the increase of the pressure inside the air chamber S. FIG. 4 illustrates a state in which air bubbles are discharged by permeating the gas permeable film 40 through the decrease of the pressure inside the air chamber S. The method for controlling the filter unit 30 of FIG. 2 involves increasing (FIG. 3) and decreasing (FIG. 4) the pressure inside the air chamber S with the pressure regulating section 28, thereby being capable of enhancing the dischargeability of air bubbles. The control of the pressure regulating section 28 as described above is performed by a program that is executed by the control device 20. The increase and the decrease of the pressure inside the air chamber S of the filter unit 30 as described above are performed, for example, in a state in which the liquid ejecting head 25 is sealed with a cap (not shown) at the time of cleaning the liquid ejecting head 25. However, the increase and the decrease of the pressure are not limited thereto. The increase of the pressure inside the air chamber S may be performed at the time of cleaning, and the decrease of the pressure inside the air chamber S may be performed at the time of printing.

For example, as illustrated in FIG. 2, it is assumed that an air bubble Bu is trapped in the internal space of the gas permeable film 40 that constitutes the flow channel P. When the control device 20 causes the pressure regulating section 28 to increase the pressure inside the air chamber S with respect to the reference pressure in the state of FIG. 2, the gas permeable film 40 is deflected inward by the increased pressure as illustrated in FIG. 3. Thus, the volume of the flow channel P on the upstream side of the filter F (in this case, the internal space of the gas permeable film 40) is decreased, and the air bubble Bu inside the flow channel P on the upstream side is forced out toward the downstream side of the filter F with the gas permeable film 40 and is discharged from the flow channel 362 along with the flow of the ink.

In this case, through the cleaning of the liquid ejecting head 25, the pressure inside the cap is decreased and the ink is sucked from the nozzles N of the liquid ejecting head 25, and thus the air bubble Bu can be discharged from the nozzles N. In the first embodiment, the air bubble Bu inside the flow channel P is forced out toward the downstream side of the filter F by using the gas permeable film 40, and hence the air bubble Bu can be discharged even with a smaller suction force than in a case where the gas permeable film 40 is not used. Further, when the pressure inside the air chamber S is increased, that is, when the air bubble Bu inside the flow channel P is forced out toward the downstream side of the filter F by using the gas permeable film 40, the ink may be pumped from the upstream side of the filter F. With this operation, the air bubble Bu can be prevented from flowing back toward the upstream side of the flow channel P.

Note that, as illustrated in FIG. 2, thin portions 46 and 48 that are smaller in thickness than other portions are formed on the flange 42 side (flow channel 322 side) and the flange 44 side (flow channel 362 side) of the gas permeable film 40, respectively. The gas permeable film 40 is deflected more easily at the thin portions 46 and 48 than at the other portions. Thus, the gas permeable film 40 can be deflected greatly inside the air chamber S as illustrated in FIG. 3. Further, the thin portion 46 on the flow channel 322 side may protrude toward the inner side of the gas permeable film 40 as illustrated in FIG. 3. With this thin portion 46, when the gas permeable film 40 is deflected inward, the diameter of the flow channel P on the flow channel 322 side of the gas permeable film 40 can be reduced, and hence the air bubble Bu on the inner side of the gas permeable film 40 is forced onto the filter F more easily than in a case where the diameter of the flow channel P is not reduced.

It is difficult to discharge the air bubble Bu completely in the state of FIG. 3 described above. A part of the air bubble Bu may remain as in the form of air bubbles Bu'. In view of this, following the operation in the state of FIG. 3, the control device 20 causes the pressure regulating section 28 to decrease the pressure inside the air chamber S with respect to the reference pressure. Then, the gas permeable film 40 is deflected outward by the decreased pressure as illustrated in FIG. 4. Thus, the volume of the flow channel P on the upstream side of the filter F (in this case, the internal space of the gas permeable film 40) is increased, and the remaining air bubbles Bu' permeate the gas permeable film 40 and are discharged from the outer side of the ink flow channel P (from the external space of the gas permeable film 40) via the gas flow channel Q.

As described above, with the filter unit 30 of FIG. 2, the dischargeability of air bubbles can be enhanced through the increase and the decrease of the pressure inside the air chamber S. Note that the period of time for decreasing (FIG. 4) the pressure inside the air chamber S with respect to the reference pressure may be set longer than the period of time for increasing (FIG. 3) the pressure inside the air chamber S with respect to the reference pressure. Thus, the period of time for discharging air bubbles via the air chamber S by causing the air bubbles to permeate the gas permeable film 40 as illustrated in FIG. 4 can be set longer than the period of time for discharging air bubbles by forcing out the air bubbles with the gas permeable film 40 as illustrated in FIG. 3.

Filter Unit According to First Modified Example

Figure 5:
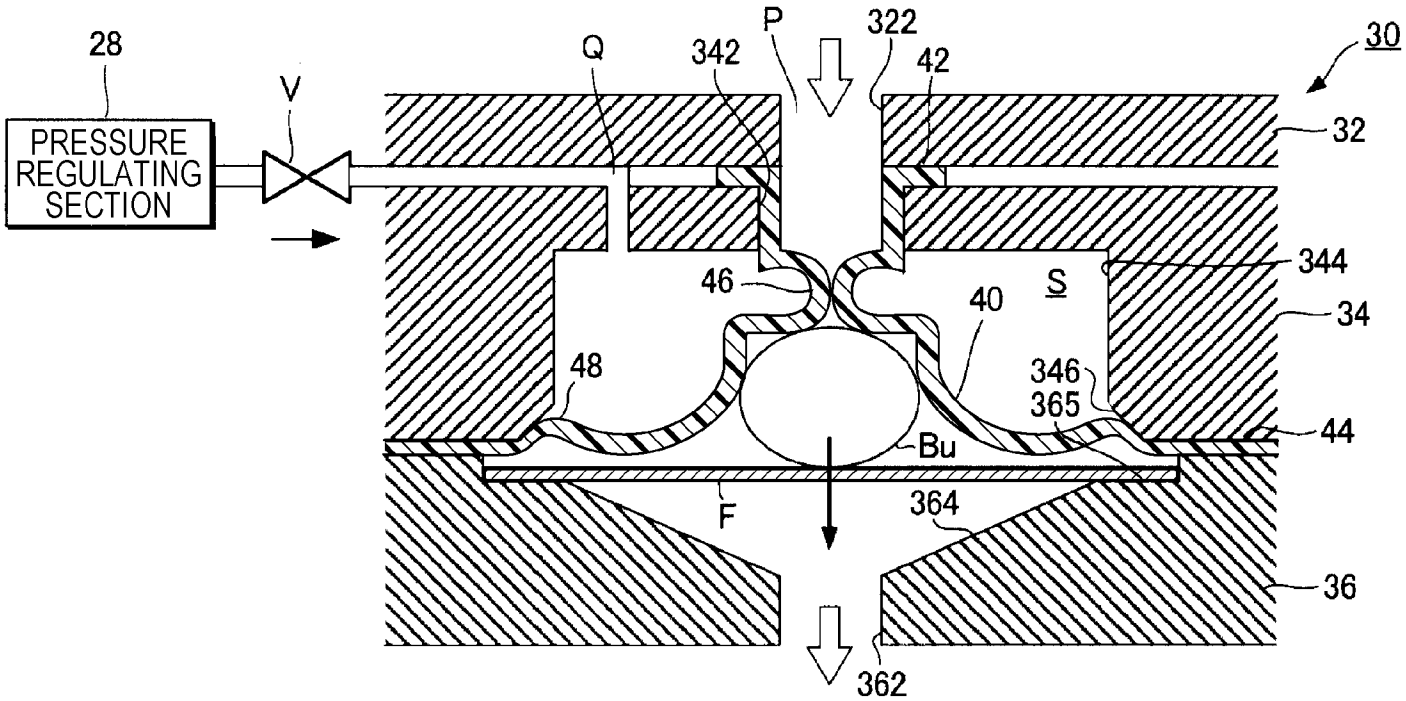
FIG. 5 is a sectional view illustrating the structure of a filter unit according to a first modified example.

FIG. 5 is a sectional view illustrating the structure of a filter unit 30 according to a first modified example. In the respective modified examples exemplified below, elements similar to those of the first embodiment in terms of operations and functions are denoted by the same reference symbols as those used in the description with reference to FIG. 2 to FIG. 4, and detailed description of those elements is omitted as appropriate.

The filter unit 30 illustrated in FIG. 5 is directed to a case where, when the gas permeable film 40 is deflected inward, the thin portion 46 on the flow channel 322 side functions as a closing portion that closes the flow channel P on the flow channel 322 side of the gas permeable film 40. With this filter unit 30, when the gas permeable film 40 is deflected inward, the thin portion 46 closes the flow channel P on the flow channel 322 side of the gas permeable film 40, and then the air bubble Bu inside the flow channel P is discharged by being forced out toward the downstream side of the filter F. Thus, the air bubble Bu can be made less liable to flow back toward the flow channel 322 side than in a case where the flow channel P on the flow channel 322 side of the gas permeable film 40 is not closed.

Filter Unit According to Second Modified Example

Figure 6:
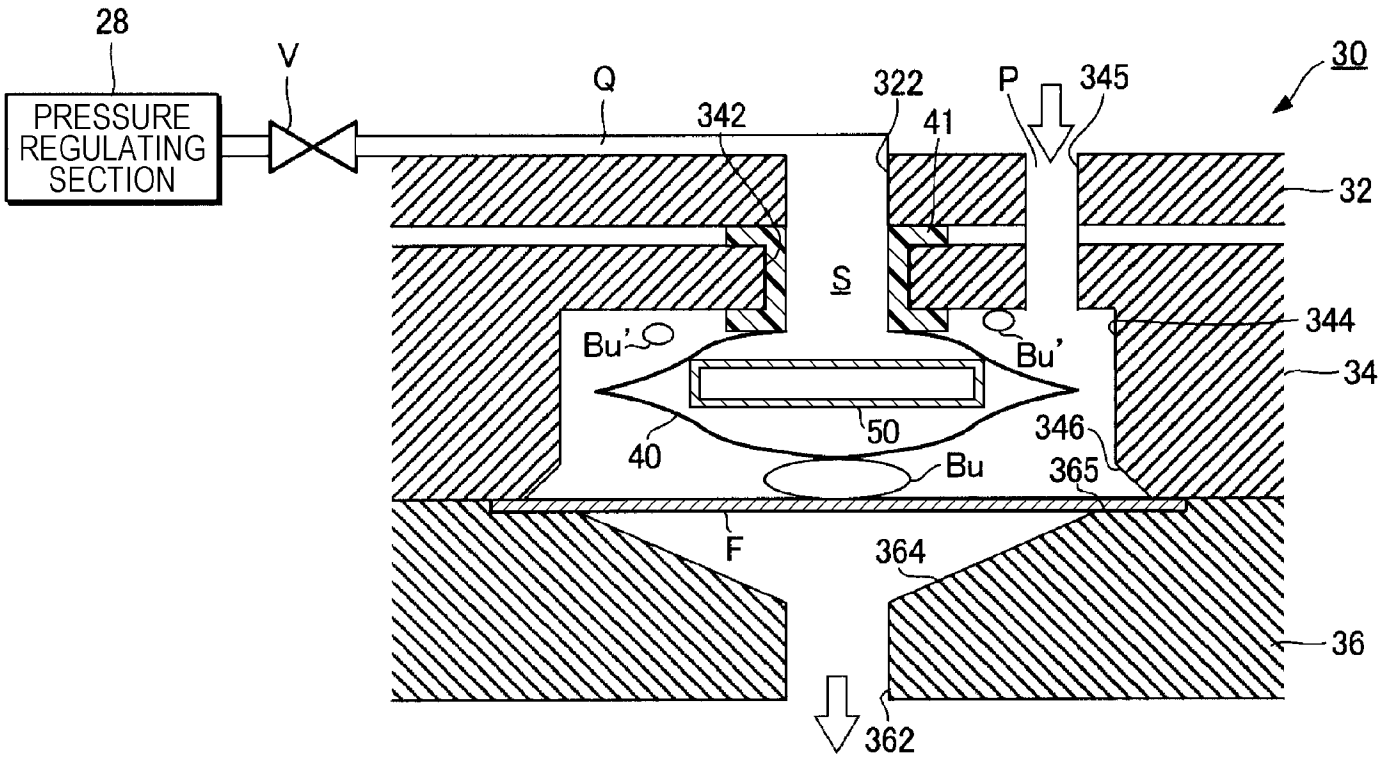
FIG. 6 is a sectional view illustrating the structure of a filter unit according to a second modified example.

FIG. 6 is a sectional view illustrating the structure of a filter unit 30 according to a second modified example. The filter unit 30 of FIG. 6 is directed to a case where the gas permeable film 40 is formed into a bag shape and the internal space of the gas permeable film 40 is set as the air chamber S. An ink flow channel 345 that communicates with the recess 344 is formed in each of the support 32 and the air chamber forming member 34. In the filter unit 30 of FIG. 2, the internal space of the gas permeable film 40, the flow channel 322, the liquid flow port 364, and the flow channel 362 constitute the flow channel P, whereas in the filter unit 30 of FIG. 6, the external space of the gas permeable film 40 (space surrounded by the inner wall of the recess 344 and the outer wall of the gas permeable film 40), the flow channel 345, the liquid flow port 364, and the flow channel 362 constitute the flow channel P. Thus, in the filter unit 30 of FIG. 2, the inner wall of the gas permeable film 40 constitutes the wall surface of the flow channel P, whereas in the filter unit 30 of FIG. 6, the outer wall of the gas permeable film 40 constitutes the wall surface of the flow channel P because the gas permeable film 40 is arranged inside the flow channel P.

In the filter unit 30 of FIG. 6, the flow channel 322 of the support 32 and the flow channel 342 of the air chamber forming member 34 constitute the gas flow channel Q. A sealing member 41 is attached to the inner peripheral surface of the flow channel 342. Also in the filter unit 30 of FIG. 6, the air pressure inside the air chamber S formed by the gas permeable film 40 having a bag shape can be changed by the pressure regulating section 28. Through such a change in the air pressure inside the air chamber S with respect to the reference pressure, the gas permeable film 40 is inflated to decrease the volume of the ink flow channel P inside the recess 344, or is deflated to increase the volume of the ink flow channel P inside the recess 344.

Thus, the pressure regulating section 28 increases the pressure inside the air chamber S with respect to the reference pressure to decrease the volume of the ink flow channel P. In this manner, air bubbles in the external space of the gas permeable film 40 can be discharged by being forced out toward the downstream side of the filter F.

Further, the pressure regulating section 28 decreases the pressure inside the air chamber S with respect to the reference pressure. In this manner, air bubbles remaining in the flow channel P on the outer side of the gas permeable film 40 can also be discharged via the air chamber S by permeating the gas permeable film 40 toward the inner side thereof. Since the gas permeable film 40 of FIG. 6 has a bag shape, it is preferred that the air inlet/outlet port (opening of the sealing member 41 which is located on the gas permeable film 40 side) be prevented from being closed due to abutment between the inner wall surfaces of the gas permeable film 40 when the gas permeable film 40 is deflated. In view of this, a frame 50 is arranged in the internal space of the gas permeable film 40 of FIG. 6. The frame 50 is a structure such as a rectangular parallelepiped skeletal structure. The structure of the frame 50 is not limited to this structure.

Figure 7:
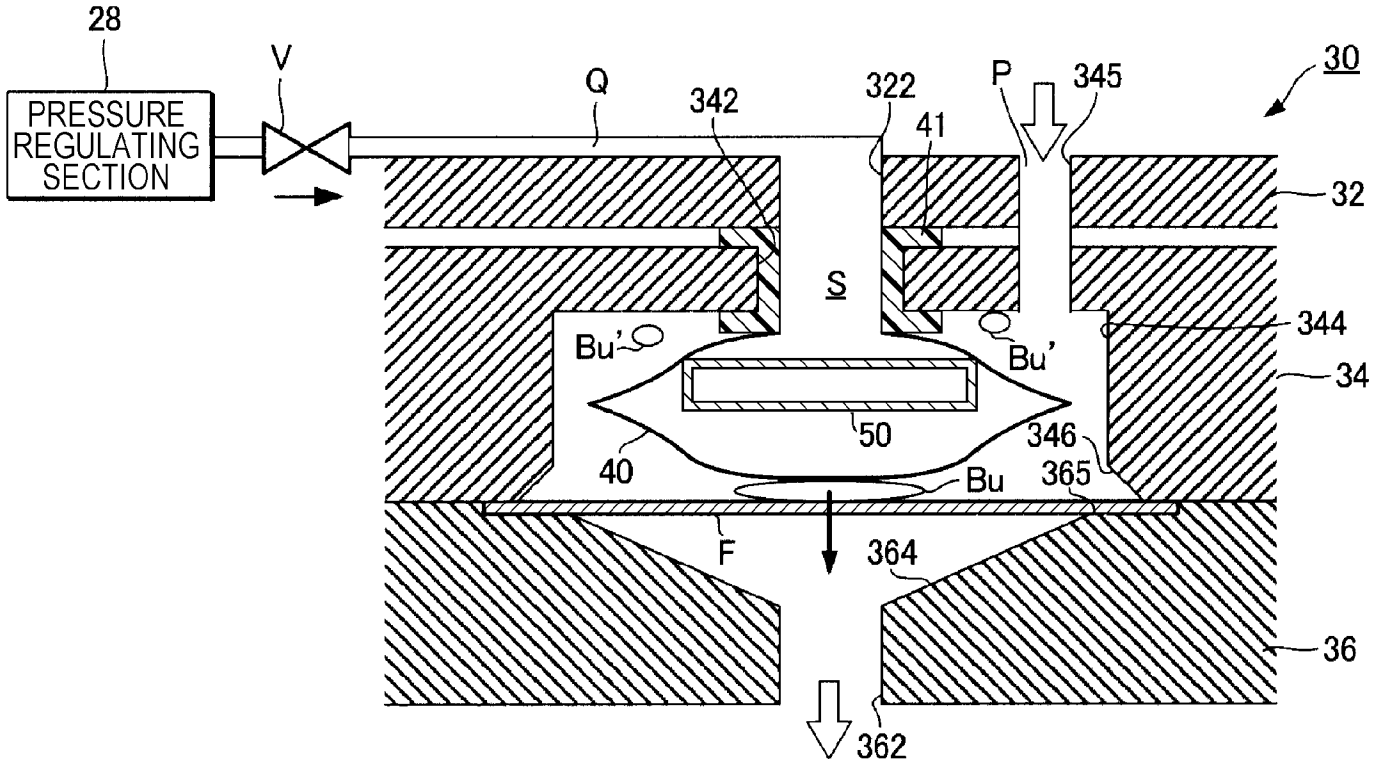
FIG. 7 is an explanatory view of an operation of the filter unit according to the second modified example.
Figure 8:
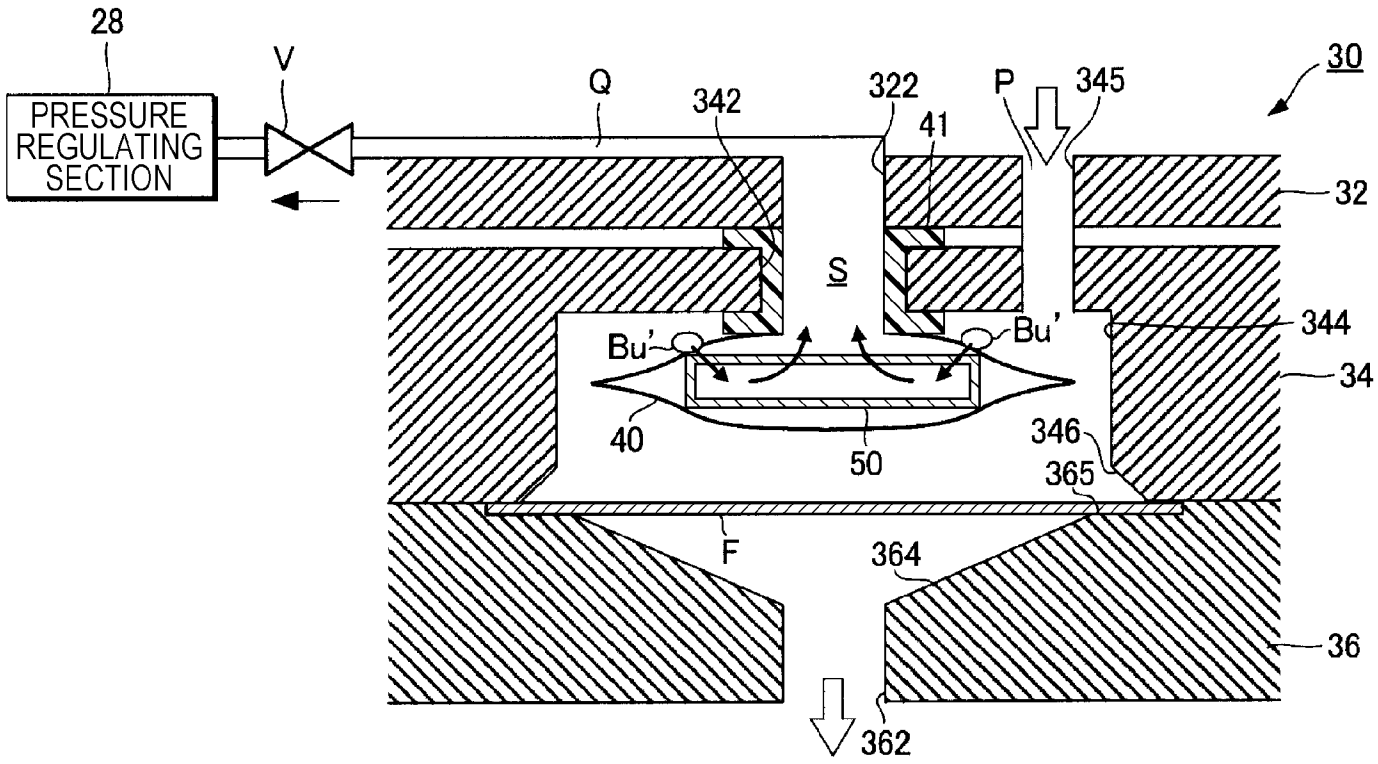
FIG. 8 is an explanatory view of the operation of the filter unit according to the second modified example.

A method for controlling the filter unit 30 having the structure described above and an operation thereof are described in detail. FIG. 7 and FIG. 8 are explanatory views of the operation of the filter unit 30 of FIG. 6. FIG. 7 illustrates a state in which air bubbles are discharged by being forced out with the gas permeable film 40 through the increase of the pressure inside the air chamber S. FIG. 8 illustrates a state in which air bubbles are discharged by permeating the gas permeable film 40 through the decrease of the pressure inside the air chamber S. Similarly to the filter unit 30 of FIG. 2, the method for controlling the filter unit 30 of FIG. 6 involves increasing (FIG. 7) and decreasing (FIG. 8) the pressure inside the air chamber S with the pressure regulating section 28, thereby being capable of enhancing the dischargeability of air bubbles with the gas permeable film 40. The control of the pressure regulating section 28 as described above is performed by a program that is executed by the control device 20.

For example, as illustrated in FIG. 6, it is assumed that the air bubble Bu and the air bubbles Bu' are contained in the external space of the gas permeable film 40 that constitutes the flow channel P. When the control device 20 causes the pressure regulating section 28 to increase the pressure inside the air chamber S with respect to the reference pressure in the state of FIG. 6, the gas permeable film 40 is inflated by the increased pressure as illustrated in FIG. 7. Thus, the volume of the flow channel P on the upstream side of the filter F is decreased, and the air bubble Bu inside the flow channel P on the upstream side is forced out toward the downstream side of the filter F with the gas permeable film 40 and is discharged from the flow channel 362 along with the flow of the ink.

When the control device 20 then causes the pressure regulating section 28 to decrease the pressure inside the air chamber S with respect to the reference pressure, the gas permeable film 40 is deflated by the decreased pressure as illustrated in FIG. 8. Thus, the volume of the flow channel P on the upstream side of the filter F is increased, and the remaining air bubbles Bu' permeate the gas permeable film 40 toward the inner side thereof and are discharged from the gas flow channel Q via the air chamber S. Note that, even when the gas permeable film 40 is deflated as illustrated in FIG. 8, the frame 50 interferes with the abutment between the inner wall surfaces of the gas permeable film 40, and hence the air inlet/outlet port (opening of the sealing member 41 which is located on the gas permeable film 40 side) can be prevented from being closed. As described above, with the filter unit 30 of FIG. 6, the dischargeability of air bubbles can be enhanced through the increase and the decrease of the pressure inside the air chamber S similarly to the case of FIG. 2.

Filter Unit According to Third Modified Example

Figure 9:
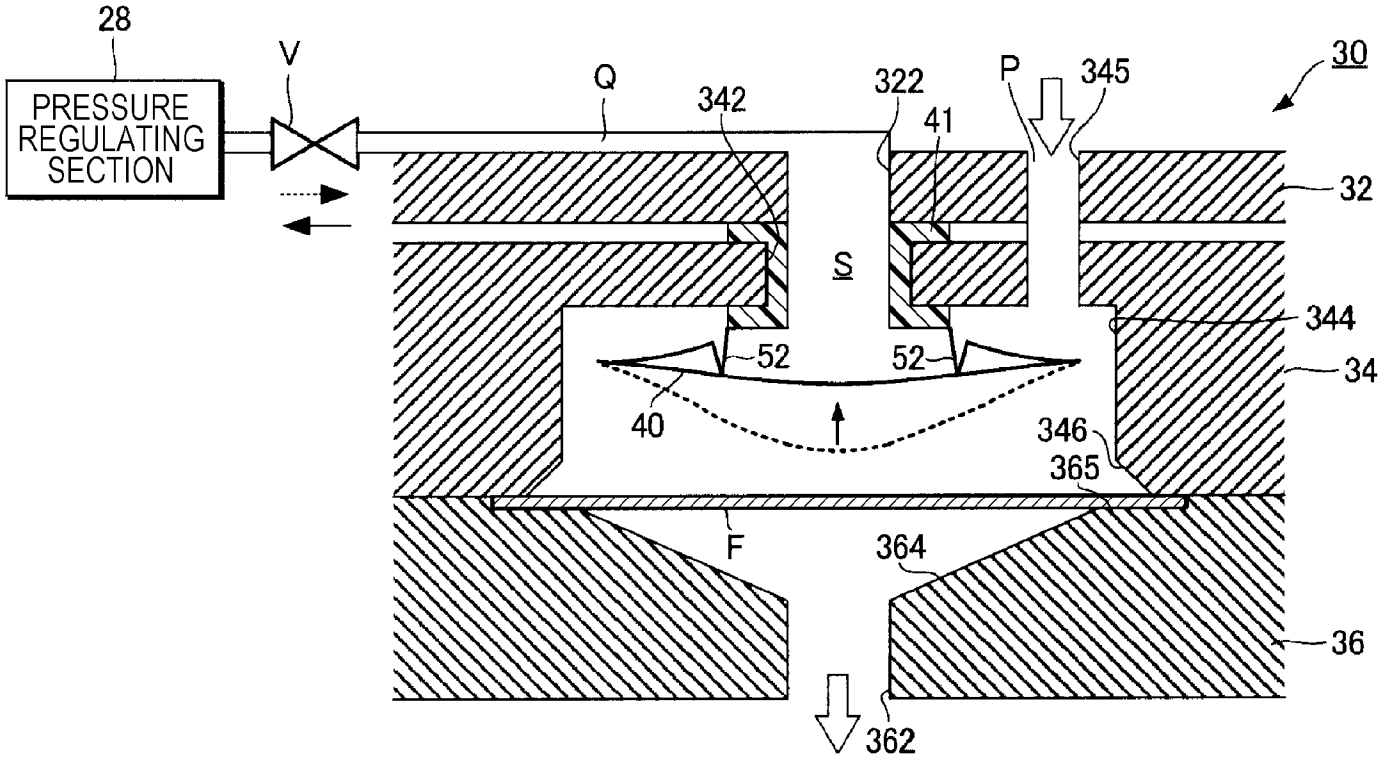
FIG. 9 is a sectional view illustrating the structure of a filter unit according to a third modified example.

FIG. 9 is a sectional view illustrating the structure of a filter unit 30 according to a third modified example. The filter unit 30 of FIG. 6 is described by exemplifying the case where the frame 50 is arranged in the internal space of the gas permeable film 40, but the filter unit 30 is not limited thereto. As in the filter unit 30 of FIG. 9, protrusions 52 that protrude toward the inner side of the gas permeable film 40 may be provided on the gas permeable film 40 instead of arranging the frame 50 in the internal space of the gas permeable film 40.

In the structure of FIG. 9, the protrusions 52 are provided so as to protrude from one of the inner surfaces of the gas permeable film 40 which face each other toward the other one of the inner surfaces. By providing such protrusions 52 on the gas permeable film 40, the protrusions 52 interfere with the abutment between the inner wall surfaces of the gas permeable film 40 even when, for example, the state in which the gas permeable film 40 is inflated as indicated by the dotted line of FIG. 9 is changed to the state in which the gas permeable film 40 is deflated as indicated by the solid line of FIG. 9. Thus, the air inlet/outlet port (opening of the sealing member 41 which is located on the gas permeable film 40 side) can be prevented from being closed.

Filter Unit According to Fourth Modified Example

Figure 10:
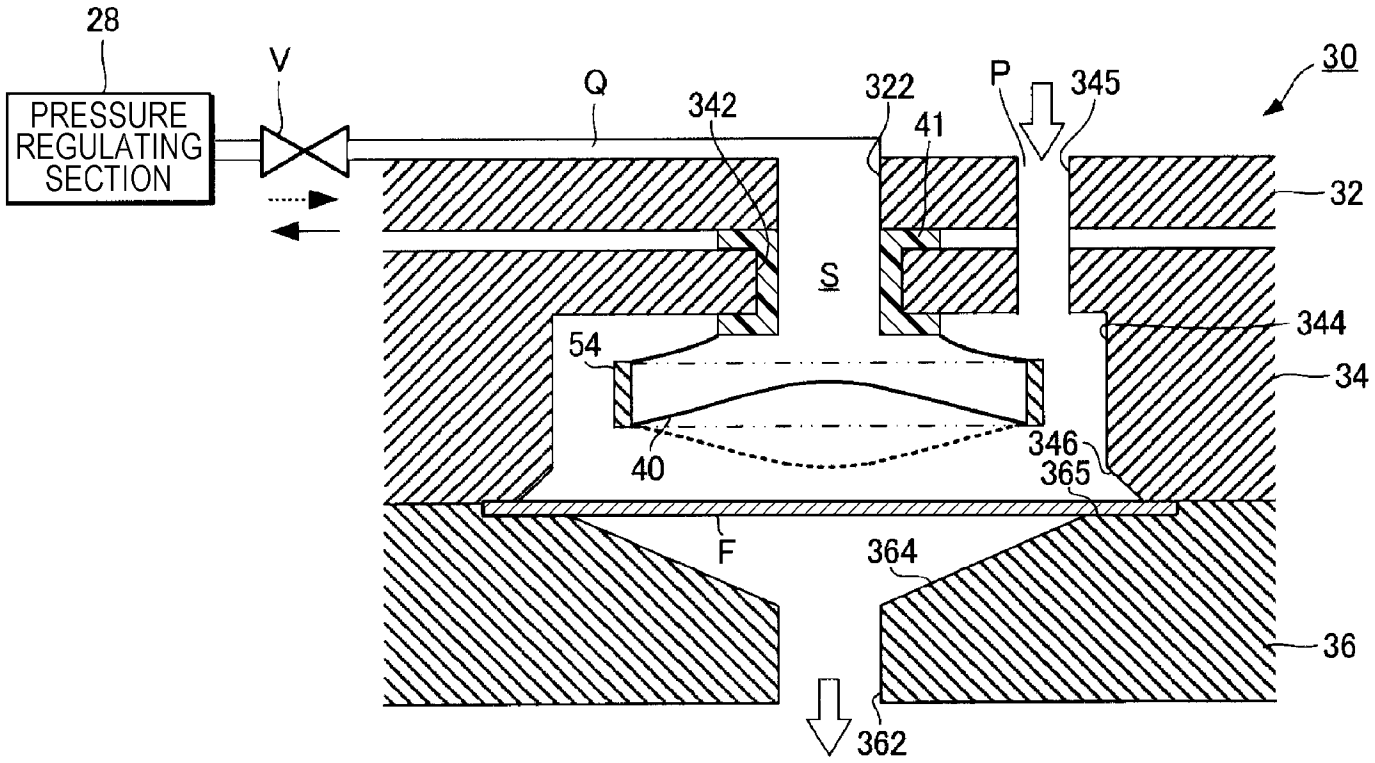
FIG. 10 is a sectional view illustrating the structure of a filter unit according to a fourth modified example.

FIG. 10 is a sectional view illustrating the structure of a filter unit 30 according to a fourth modified example. The filter unit 30 of FIG. 10 is described by exemplifying a case where a frame 54 is fixed to the outer side of the gas permeable film 40. The frame 54 may have a structure other than the skeletal structure unlike the frame 50 illustrated in FIG. 6, and may therefore be, for example, a belt-like plate member as illustrated in FIG. 10. By fixing the frame 54 so as to surround the outer periphery of the gas permeable film 40, the inner wall surfaces of the gas permeable film 40 do not abut against each other at the portion corresponding to the frame 54 even when, for example, the state in which the gas permeable film 40 is inflated as indicated by the dotted line of FIG. 10 is changed to the state in which the gas permeable film 40 is deflated as indicated by the solid line of FIG. 10. Thus, the air inlet/outlet port (opening of the sealing member 41 which is located on the gas permeable film 40 side) can be prevented from being closed.

Second Embodiment

Figure 11:
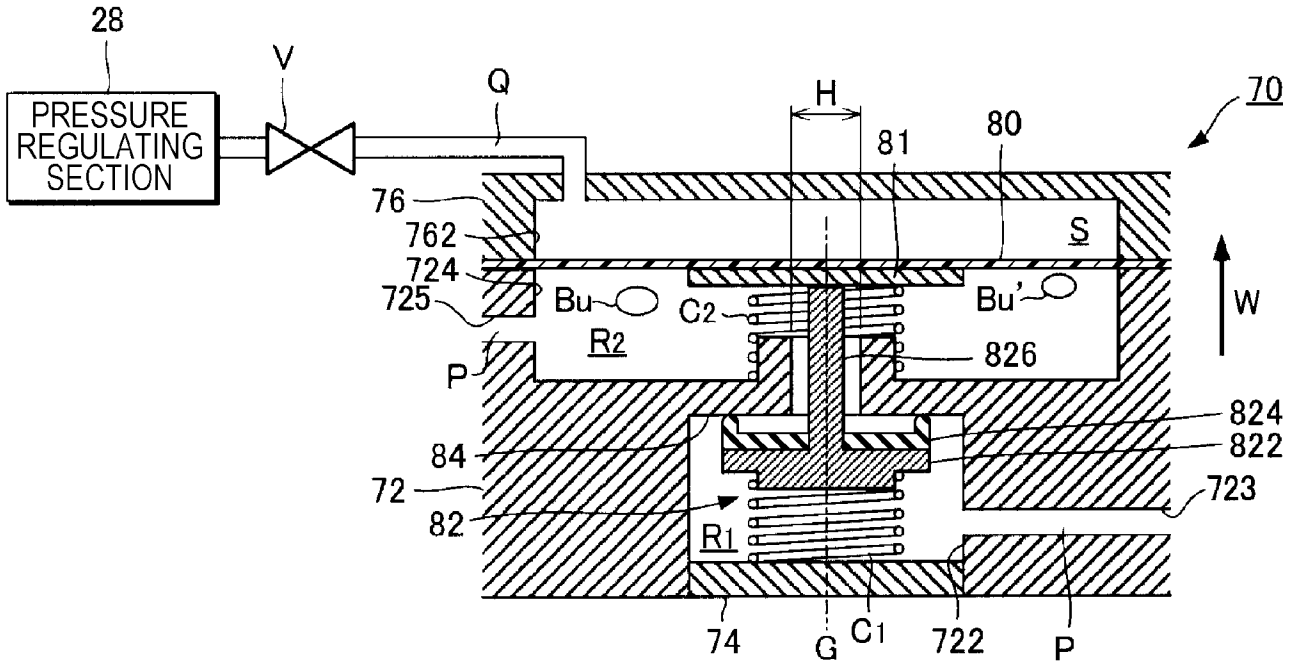
FIG. 11 is a sectional view illustrating the structure of a valve unit of a second embodiment.

A second embodiment of the invention is described. In the embodiment exemplified below, elements similar to those of the first embodiment in terms of operations and functions are denoted by the same reference symbols as those used in the description of the first embodiment, and detailed description of those elements is omitted as appropriate. FIG. 11 is a structural view of a valve unit 70 according to the second embodiment of the invention. The first embodiment is described by exemplifying the case where the gas permeable film is applied to the filter unit 30, but the second embodiment is described for a case where the gas permeable film is applied to the valve unit 70.

Valve Unit

The valve unit 70 of the second embodiment illustrated in FIG. 11 includes a support 72, a sealing body 74, an air chamber forming member 76, and a gas permeable film 80. The sealing body 74 is fixed to one surface of the support 72 having a flat-plate shape, and the gas permeable film 80 is fixed between the other surface of the support 72 and the air chamber forming member 76. A recess 722 having a substantially circular shape in plan view is formed on the surface of the support 72 which is located on the sealing body 74 side. A recess 724 having a substantially circular shape is also formed on the surface of the support 72 which is located on the gas permeable film 80 side. A recess 762 having a substantially circular shape is also formed in the air chamber forming member 76.

An ink inlet 723 that communicates with the recess 722 and an ink outlet 725 that communicates with the recess 724 are formed in the support 72. The space surrounded by the recess 722 and the sealing body 74 functions as a first flow channel $R_1$ on the ink inflow side, and the space surrounded by the recess 724 and the gas permeable film 80 functions as a second flow channel $R_2$. The first flow channel $R_1$ and the second flow channel $R_2$ function as the flow channel P through which the ink supplied from the liquid container 14 via the liquid supplying tube 16 is supplied to the liquid ejecting head 25. Thus, the gas permeable film 80 defines the wall of the flow channel P (second flow channel $R_2$).

The gas permeable film 80 of the second embodiment is a flexible member that has a flat-plate shape and allows permeation of gas while preventing permeation of liquid, and is formed of a resin material such as polypropylene (PP). The gas permeable film 80 is attached so as to be deformable toward a positive side and a negative side of a W direction. A pressure receiving plate 81 is arranged on the surface of the gas permeable film 80. The pressure receiving plate 81 is, for example, a flat plate member having a substantially circular shape. The gas permeable film 80 defines the wall of the flow channel P (second flow channel $R_2$) and also functions as a movable portion that opens/closes a valve body 82 provided between the first flow channel $R_1$ and the second flow channel $R_2$.

The valve body 82 is arranged inside the first flow channel $R_1$, and is urged by an urging member (for example, a spring) $C_1$ so as to be pressed against a valve seat 84. The valve seat 84 is a portion of the support 72 which is located between the first flow channel $R_1$ and the second flow channel $R_2$ (bottom of the recess 722 or the recess 724), and faces the gas permeable film 80 with a distance therebetween. A through hole H that passes through the support 72 is formed substantially at the center of the valve seat 84. The through hole H is a perfectly circular hole having an inner peripheral surface that is parallel to the W direction. The first flow channel $R_1$ located on an upstream side of the valve seat 84 and the second flow channel $R_2$ located on a downstream side of the valve seat 84 communicate with each other via the through hole H of the valve seat 84.

The valve body 82 includes a base portion 822, a sealing portion 824, and a valve shaft 826. The base portion 822 is a portion that has a flat-plate shape and is molded into a circular shape with an outer diameter larger than the inner diameter of the through hole H. The valve shaft 826 protrudes coaxially and perpendicularly from the surface of the base portion 822, and the sealing portion 824 having an annular shape that surrounds the valve shaft 826 in plan view is arranged on the surface of the base portion 822. The valve body 82 is arranged so that the base portion 822 and the sealing portion 824 are located inside the first flow channel $R_1$ in a state in which the valve shaft 826 having an axis G directed in the W direction is inserted into the through hole H of the valve seat 84. A clearance is secured between the inner peripheral surface of the through hole H of the valve seat 84 and the outer peripheral surface of the valve shaft 826.

The sealing portion 824 of the valve body 82 is located between the base portion 822 and the valve seat 84 to function as a seal that is brought into contact with the valve seat 84 to close the through hole H. Specifically, the sealing portion 824 is brought into contact with the surface of the valve seat 84 which is located on the first flow channel $R_1$ side. The urging member $C_1$ is arranged between the sealing body 74 and the base portion 822 of the valve body 82 to urge the valve body 82 in the W direction, that is, toward the valve seat 84 side. In addition, an urging member (for example, a spring) $C_2$ is also arranged between the valve seat 84 and the pressure receiving plate 81. The urging member $C_2$ urges the pressure receiving plate 81 in the W direction.

In the second embodiment, the space surrounded by the recess 762 of the air chamber forming member 76 and the gas permeable film 80 functions as the air chamber S. The gas flow channel Q that communicates with the recess 762 is formed in the air chamber forming member 76. The check valve V is provided in the gas flow channel Q, and communicates with the pressure regulating section 28. With the pressure regulating section 28, the air pressure inside the air chamber S can be changed. Through such a change in the air pressure inside the air chamber S, the gas permeable film 80 is deflected to increase/decrease the volume of the ink flow channel P (second flow channel $R_2$).

Method for Controlling Valve Unit and Operation Thereof

Figure 12:
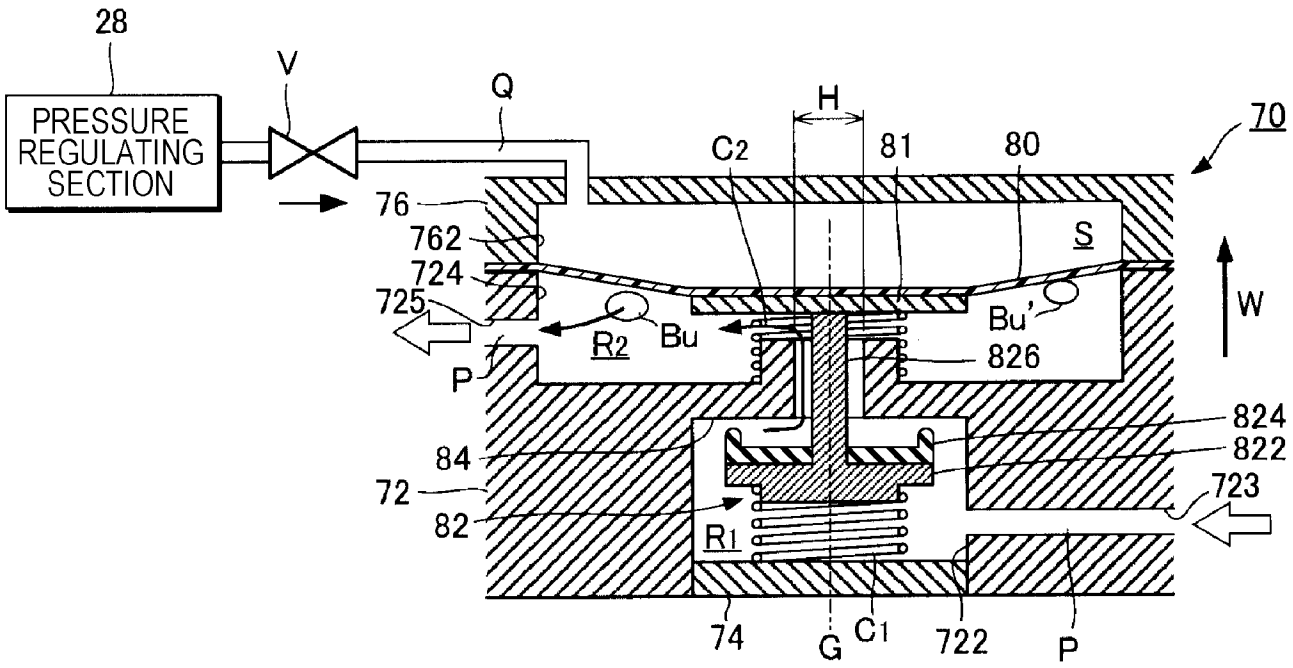
FIG. 12 is an explanatory view of an operation of the valve unit.
Figure 13:
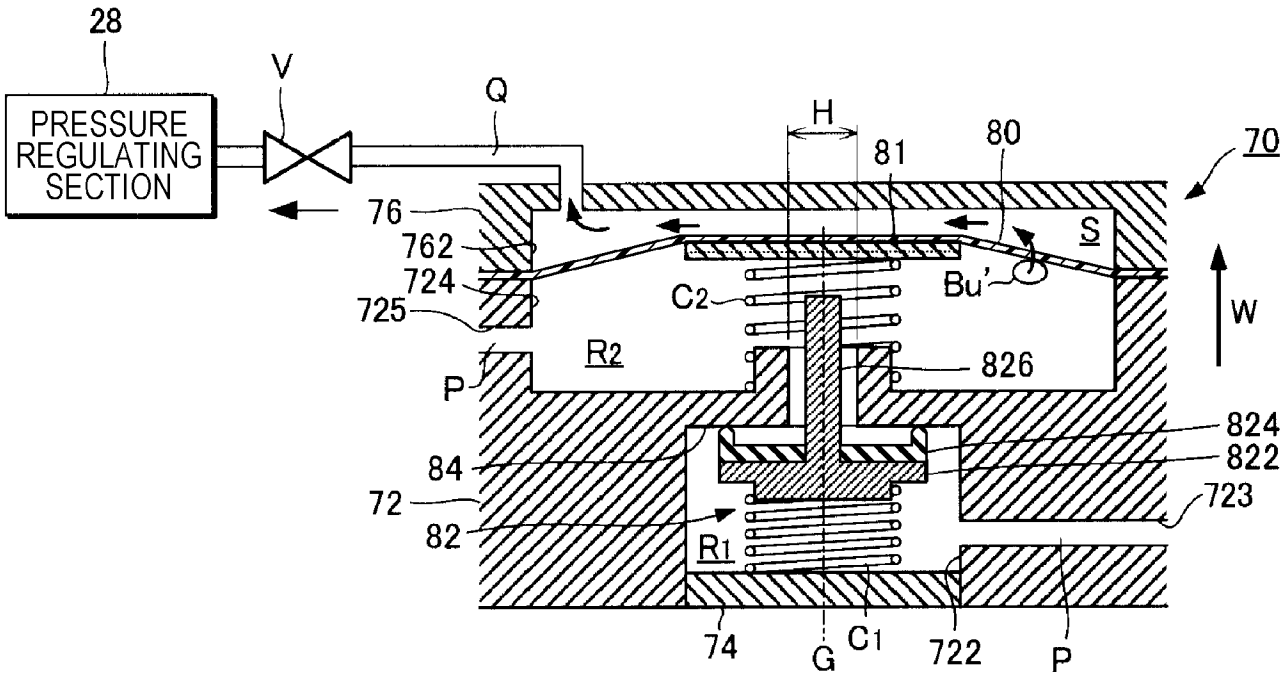
FIG. 13 is an explanatory view of the operation of the valve unit.

Next, a method for controlling the valve unit 70 and an operation thereof are described in detail. FIG. 12 and FIG. 13 are explanatory views of the operation of the valve unit 70 of FIG. 11. FIG. 12 illustrates a state in which air bubbles are discharged through the opening of the valve body 82 with the gas permeable film 80, which is caused by the increase of the pressure inside the air chamber S. FIG. 13 illustrates a state in which air bubbles are discharged by permeating the gas permeable film 80 through the closing of the valve body 82 with the gas permeable film 80, which is caused by the decrease of the pressure inside the air chamber S. The method for controlling the valve unit 70 of FIG. 11 involves increasing (FIG. 12) and decreasing (FIG. 13) the pressure inside the air chamber S with the pressure regulating section 28, thereby being capable of enhancing the dischargeability of air bubbles. The control of the pressure regulating section 28 as described above is performed by a program that is executed by the control device 20.

For example, as illustrated in FIG. 11, it is assumed that the air bubble Bu and the air bubble Bu' are contained in an internal space of the gas permeable film 80 that constitutes the flow channel P. When the control device 20 causes the pressure regulating section 28 to increase the pressure inside the air chamber S with respect to the reference pressure in the state of FIG. 11, the gas permeable film 80 is deflected and displaced toward the negative side of the W direction by the increased pressure to open the valve body 82 as illustrated in FIG. 12. Specifically, the valve body 82 moves toward the negative side of the W direction against the urging force of the urging member $C_1$ to separate the sealing portion 824 away from the valve seat 84. Therefore, the through hole H of the valve seat 84 is opened to enable the first flow channel $R_1$ and the second flow channel $R_2$ to communicate with each other via the through hole H. Thus, the ink flows from the inlet 723 in the first flow channel $R_1$ to the outlet 725 in the second flow channel $R_2$ via the through hole H, and hence the air bubble Bu inside the flow channel P in the second flow channel $R_2$ is discharged from the outlet 725 along with the flow of the ink. Moreover, when the gas permeable film 80 is deflected toward the negative side of the W direction, the volume of the second flow channel $R_2$ is decreased to increase the flow rate of the ink, and hence the air bubble Bu is discharged more easily as well.

When the control device 20 then causes the pressure regulating section 28 to decrease the pressure inside the air chamber S with respect to the reference pressure, the gas permeable film 80 is deflected and displaced toward the positive side of the W direction by the decreased pressure to close the valve body 82 as illustrated in FIG. 13. Specifically, the valve body 82 moves toward the positive side of the W direction to bring the sealing portion 824 into abutment against the valve seat 84. Therefore, the through hole H of the valve seat 84 is closed to disconnect the first flow channel $R_1$ and the second flow channel $R_2$ from each other. At this time, the remaining air bubble Bu' permeates the gas permeable film 80 to exit toward the outside of the ink flow channel P. Thus, the air bubble Bu' is discharged via the gas flow channel Q. Moreover, when the gas permeable film 80 is deflected toward the positive side of the W direction, the volume of the second flow channel $R_2$ is increased to facilitate the movement of the air bubble Bu'. Therefore, the air bubble Bu' is forced toward the gas permeable film 80 more easily, and thus discharged more easily as well.

As described above, with the valve unit 70 of FIG. 11 as well, the dischargeability of air bubbles can be enhanced through the increase and the decrease of the pressure inside the air chamber S. Note that the valve unit 70 may also function as a self-sealing valve that causes the first flow channel $R_1$ on the upstream side and the second flow channel $R_2$ on the downstream side to communicate with each other in response to a variation in the pressure on the downstream side. Specifically, in a normal operation state in which the pressure inside the second flow channel $R_2$ is maintained within a predetermined range, the valve body 82 is maintained in the closed state, that is, in the state in which the first flow channel $R_1$ and the second flow channel $R_2$ are disconnected from each other. With this operation, in a state in which the ink is not consumed (non-printing state), the valve body 82 is brought into the closed state even when the ink is pumped from a liquid pumping section 66 on the upstream side of the valve unit 70. Thus, the ink from the liquid pumping section 66 is not supplied to a common liquid chamber SR on the downstream side of the valve unit 70.

Meanwhile, when the pressure inside the second flow channel $R_2$ is decreased due to, for example, ink ejection or suction from the outside, the valve body 82 is brought into the open state, that is, into the state in which the first flow channel $R_1$ and the second flow channel $R_2$ communicate with each other. With this operation, in a printing state, the ink temporarily stored in the common liquid chamber SR is ejected from the nozzles N via pressure chambers SC, and hence the ink is consumed. Then, the pressure is decreased along with the decrease of the ink in the second flow channel $R_2$, and hence the second flow channel $R_2$ has a negative pressure. Thus, the valve body 82 is brought into the open state, and the ink is supplied from the first flow channel $R_1$ to the second flow channel $R_2$. Therefore, the ink from the liquid pumping section 66 is supplied to the common liquid chamber SR. When the negative pressure in the second flow channel $R_2$ of the valve unit 70 is then eliminated by the flow of the ink into the second flow channel $R_2$, the valve body 82 is brought into the closed state again, and the ink supply to the common liquid chamber SR is stopped.

As described above, in the case where the valve unit 70 functions as the self-sealing valve, when the valve body 82 is open, air bubbles can be discharged along with the flow of the ink, and even when the valve body 82 is closed, air bubbles can be discharged by permeating the gas permeable film 80 through the decrease of the pressure inside the air chamber S with respect to the reference pressure. In this manner, air bubbles can be discharged both when the valve body is open and when the valve body is closed. Accordingly, the dischargeability of air bubbles can be enhanced as compared to a case where air bubbles can be discharged only when the valve body is open.

Modified Examples

The respective embodiments exemplified above may be modified in various ways. Specific modified embodiments are exemplified below. Two or more embodiments which are arbitrarily selected from the following exemplified embodiments may be combined as appropriate without causing contradiction therebetween.

(1) The structure of the liquid ejecting head 25 may be changed as appropriate. For example, the piezoelectric liquid ejecting head 25 that uses a piezoelectric element that applies mechanical vibration to a pressure chamber is exemplified in the respective embodiments described above, but a thermal liquid ejecting head that uses a heating element that generates an air bubble inside a pressure chamber by heating may be employed instead. Further, the structure of the plurality of nozzles N of the liquid ejecting head 25 is not limited to the exemplified structure in the respective embodiments described above.

(2) The printer exemplified in the respective embodiments described above may be employed not only in an apparatus dedicated to printing, but also in a facsimile apparatus, a copying machine, and various other apparatuses. As a matter of course, the application of the liquid ejecting apparatus of the invention is not limited to printing. For example, a liquid ejecting apparatus that ejects a solution of a color material is used as a manufacturing apparatus that forms a color filter of a liquid crystal display apparatus. Further, a liquid ejecting apparatus that ejects a solution of a conductive material is used as a manufacturing apparatus that forms a wire or an electrode of a wiring substrate.

What is claimed is:

1. A liquid ejecting apparatus, comprising:

a flow channel through which liquid is supplied to a liquid ejecting head;

a gas permeable film that constitutes a wall surface of the flow channel;

an air chamber that is separated from the flow channel through intermediation of the gas permeable film;

a filter that is provided midway along the flow channel so as to face the gas permeable film, and partitions the flow channel into an upstream side and a downstream side; and a pressure regulating section for changing an air pressure inside the air chamber, wherein the gas permeable film is configured to change a volume of the flow channel through a change in the air pressure inside the air chamber with the pressure regulating section, and allow permeation of an air bubble when the pressure regulating section decreases the air pressure inside the air chamber, wherein the pressure regulating section comprises a pump in direct communication with the air chamber such that that the gas permeable film does not intervene in the direct communication, wherein the gas permeable film is arranged on the upstream side of the filter in the flow channel, wherein, when the gas permeable film decreases the volume of the flow channel on the upstream side, the air bubble inside the flow channel on the upstream side is discharged by being forced out toward the downstream side of the filter, and wherein, when the gas permeable film increases the volume of the flow channel on the upstream side, the air bubble inside the flow channel on the upstream side is discharged by permeating the gas permeable film.

2. The liquid ejecting apparatus according to claim 1, further comprising a check valve that communicates with the air chamber and prevents entry of air into the air chamber.

3. The liquid ejecting apparatus according to claim 2, wherein a period of time for decreasing the air pressure inside the air chamber with respect to a reference pressure is longer than a period of time for increasing the air pressure inside the air chamber with respect to the reference pressure.

4. The liquid ejecting apparatus according to claim 1, wherein the gas permeable film has a bag shape, and is arranged inside the flow channel with an internal space of the gas permeable film set as the air chamber, and wherein the air chamber is provided with a frame that prevents an air inlet/outlet port from being closed by the gas permeable film.

5. The liquid ejecting apparatus according to claim 1, wherein the gas permeable film has a bag shape with inner surfaces facing each other, and is arranged inside the flow channel with an internal space of the gas permeable film set as the air chamber, and wherein the gas permeable film is provided with a protrusion that protrudes from one of the inner surfaces facing each other toward another one of the inner surfaces facing each other.

6. The liquid ejecting apparatus according to claim 1, wherein the gas permeable film forms, inside the flow channel, a wall surface that covers the flow channel, and wherein, when the gas permeable film decreases the volume of the flow channel, a closing portion that closes the flow channel by being deflected toward an inner side of the flow channel on the upstream side of the filter is formed on the gas permeable film.

7. The liquid ejecting apparatus according to claim 6, wherein, when the gas permeable film decreases the volume of the flow channel, the air bubble inside the flow channel is discharged by being forced out toward the downstream side of the filter after the closing portion closes the flow channel.

8. The liquid ejecting apparatus according to claim 1, wherein the gas permeable film forms, inside the flow channel, a wall surface that covers the flow channel, and wherein, when the gas permeable film decreases the volume of the flow channel, the liquid is pumped from the upstream side of the flow channel.

9. A liquid ejecting apparatus, comprising:

a flow channel through which liquid is supplied to a liquid ejecting head;

a gas permeable film that constitutes a wall surface of the flow channel;

an air chamber that is separated from the flow channel through intermediation of the gas permeable film;

a valve body that is provided midway along the flow channel, and opens/closes the flow channel;

a switching member that switches opening/closing of the valve body along with displacement of the gas permeable film; and a pressure regulating section for changing an air pressure inside the air chamber, wherein the gas permeable film is configured to change a volume of the flow channel through a change in the air pressure inside the air chamber with the pressure regulating section, and allow permeation of an air bubble when the pressure regulating section decreases the air pressure inside the air chamber, wherein the pressure regulating section comprises a pump in direct communication with the air chamber such that that the gas permeable film does not intervene in the direct communication.

10. The liquid ejecting apparatus according to claim 9, wherein, when the gas permeable film is displaced so as to decrease the volume of the flow channel, the switching member opens the valve body to discharge the air bubble inside the flow channel by causing the air bubble to flow toward the downstream side, and wherein, when the gas permeable film is displaced so as to increase the volume of the flow channel, the switching member closes the valve body to discharge the air bubble inside the flow channel by causing the air bubble to permeate the gas permeable film.

11. A method for controlling a liquid ejecting apparatus including a liquid ejecting head, a flow channel through which liquid is supplied to the liquid ejecting head, a gas permeable film that constitutes a wall surface of the flow channel, an air chamber that is separated from the flow channel through intermediation of the gas permeable film, and a pressure regulating section that increases/decreases an air pressure inside the air chamber with respect to a reference pressure, the method comprising:

changing the air pressure inside the air chamber with the pressure regulating section;

decreasing a volume of the flow channel through the changing of the air pressure inside the air chamber; and increasing the volume of the flow channel through the changing of the air pressure inside the air chamber, wherein the pressure regulating section comprises a pump in direct communication with the air chamber such that that the gas permeable film does not intervene in the direct communication, wherein the liquid ejecting apparatus further includes a filter that is provided midway along the flow channel so as to face the gas permeable film, and partitions the flow channel into an upstream side and a downstream side, wherein the gas permeable film is arranged on the upstream side of the filter in the flow channel, and wherein the method includes discharging an air bubble inside the flow channel on the upstream side by forcing out the air bubble toward the downstream side of the filter through the decreasing of the volume of the flow channel.

12. A method for controlling a liquid ejecting apparatus including a liquid ejecting head, a flow channel through which liquid is supplied to the liquid ejecting head, a gas permeable film that constitutes a wall surface of the flow channel, an air chamber that is separated from the flow channel through intermediation of the gas permeable film, and a pressure regulating section that increases/decreases an air pressure inside the air chamber with respect to a reference pressure, the method comprising:

changing the air pressure inside the air chamber with the pressure regulating section;

decreasing a volume of the flow channel through the changing of the air pressure inside the air chamber; and increasing the volume of the flow channel through the changing of the air pressure inside the air chamber, wherein the pressure regulating section comprises a pump in direct communication with the air chamber such that that the gas permeable film does not intervene in the direct communication, wherein the liquid ejecting apparatus further includes:

a valve body that is provided midway along the flow channel so as to face the gas permeable film, and opens/closes the flow channel; and a switching member that switches opening/closing of the valve body along with displacement of the gas permeable film, and wherein the method includes discharging an air bubble inside the flow channel by causing the air bubble to flow toward the downstream side through opening of the valve body with the switching member, which is caused by displacing the gas permeable film so as to decrease the volume of the flow channel.

* * * * *